US005781182A

United States Patent [19]

Liu et al.

[11] Patent Number: 5,781,182

[45] Date of Patent: Jul. 14, 1998

[54] LINE BUFFER APPARATUS WITH AN EXTENDIBLE COMMAND

[75] Inventors: Hsiung-hao Liu, Hsinchu Hsien; Ching-hao Hsu, Hsinchu, both of Taiwan

[73] Assignee: Winbond Electronics Corp., Taiwan, Taiwan

[21] Appl. No.: 752,292

[22] Filed: Nov. 19, 1996

[51] Int. Cl.[6] ..... G09G 5/00

[52] U.S. Cl. ..... 345/196; 345/507

[58] Field of Search ..... 345/507, 196, 345/522, 515

[56] References Cited

U.S. PATENT DOCUMENTS 5,023,776 6/1991 Gregor ..... 711/122

*Primary Examiner*—Kee M. Tung

*Attorney, Agent, or Firm*—Michaelson & Wallace; Peter L. Michaelson

[57] ABSTRACT

A line buffer apparatus with an extendible command queue length, includes a first level command queue for receiving commands from a computer; a line buffer for temporarily receiving video data or a command queue, the line buffer including a data input port and a data output port; a first multiplexer and a second multiplexer respectively connected to the data input port and the data output port of the line buffer for operatively enabling the line buffer to receive command data coming from a first level command queue or video data coming from a memory, and to output data into a graphic engine or a two dimensional operating device; a controller for controlling the two multiplexers to selectively connect the line buffer between the first level command queue and the graphic engine so as to treat the line buffer as a second level command queue when the line buffer does not temporarily store video, thereby flexibly extending the command queue length of an video window accelerator.

16 Claims, 2 Drawing Sheets

LINE BUFFER APPARATUS WITH AN EXTENDIBLE COMMAND

BACKGROUND OF THE INVENTION

1. Field of the Invention

The present invention relates to a line buffer apparatus with an extendible command queue length, especially one which is used in a graphic accelerator as a line buffer for video enlargement and which is adapted to function as a command queue for flexibly raising the storage capacity of the command queue of the accelerator, thus promoting the efficiency of the accelerator.

2. Description of the Prior Art

Computer devices have become very popular in this decade especially since the windows™ operating system has introduced graphic displays in addition to word display, thus a graphic operating mode allowing graphic and text inputs has replaced the conventional purely text mode. Since the processing of graphics is much slower than the processing of text, the acceleration of graphic process is accordingly a main target in this field. For improving the speed of the graphic processing, various of graphic accelerators have been developed. In accelerating the speed of graphics, a graphic processor (graphic engine) in the display system is fully responsible for the transformation and other movement of the graphics while the central processing unit (CPU) of the computer merely sends commands to the graphic processor which will accept the commands and executes the related transformation of the graphics. Therefore, the central processing unit can save time for other processes without spending too much time in dealing the graphics. For example, FIG. 1 illustrates a bit block transformation from a first position of the screen with a source address (X1, Y1), to a second position of the screen with a destination address (X2, Y2), i.e., a source block S is transformed to a destination block D. For a computer without installing a window accelerator, the CPU thereof has to read the total contents of the memory in the address corresponding to the source address and then write the contents into a memory corresponding to the destination address. As to a computer installed with a window accelerator, the CPU merely provides the source address of the graphic block, the destination address of the graphic block, the length and the width of the graphic block, and the window accelerator will transform the graphic block to the destination without using the CPU any more thereby releasing the CPU to perform other functions.

In addition to the above functions, the window accelerator includes a command queue to receive the commands sent from the CPU. Actually, this command queue is a command buffer for receiving the commands sent from the CPU thus releasing the CPU to do other jobs immediately. Therefore, the longer the command queue, the better efficiency the CPU can achieve. However, the longer the command queue, the higher the hardware costs. Therefore, the length of the command is usually set in a limited length for economic reason but this sacrifices the efficiency of the CPU.

As for an video graphic accelerator which is a combination of a window accelerator and an video processor, the functions thereof are video enlargement which is done by the video processor and graphics transformation which is done by the graphic accelerator. For reaching high quality of enlargement, a method called "two-dimension biline interpolation algorithm" is used, which, for example, determines the value of a pixel P(x+dx, y+dy) positioned in a coordinate (x+dx, y+dy) by four pixels: P(x, y), P(x+1, y), P(x, y+1), and P(x+1, y+1). For reaching this purpose, the video processor has an built-in line buffer for storing a whole line of pixels as the source for next time of interpolation data. Based on the standard specification of source input format (SIF), the line buffer is a first in first out (FIFO) buffer with 16 bits multiplied by 352 layers. This line buffer occupies relatively large space of the hardware. Actually, this line buffer is used only during video enlargement procedure, and it is in an idle status during other time, therefore, the efficiency thereof is relatively low.

It is appreciated that the video window accelerator has two drawbacks to be overcome: firstly, the command queue is not long enough to gain sufficient efficiency due to consideration of hardware cost; secondly, the line buffer is used only during the video enlargement procedure while being suspended during other times, thus it is not used efficiently.

SUMMARY OF THE INVENTION

The primary objective of the present invention is to provide a line buffer apparatus with an extendible command queue length which enables a line buffer of an video window accelerator to be subsequent to an original command queue when an video enlargement operations is not executed, thus treating the line buffer as a second command queue and extending the physical length of the whole command queue thus promoting the efficiency of the accelerator and releasing the burden of a CPU.

Another objective of the present invention is to provide a line buffer apparatus with an extendible command queue length which has an input terminal and an output terminal respectively connected to a multiplexer, and the multiplexers are controlled by a command queue controller and a read controller so as to connect the line buffer with an original command queue, thereby increasing the effective length of the original command queue.

Another objective of the present invention is to provide a line buffer apparatus with extendible command queue length, where the line buffer is extendible from 16 bits multiplied by 352 layers into 19 bits multiplied by 352 layers for matching the data pattern of a command queue of an video window accelerator which has 38 bits separated into a high byte and a low byte and each byte includes 19 bits. Therefore, the line buffer can extend the length of the command queue simply by increasing its bit number from 16 to 19.

Another objective of the present invention is to provide a line buffer apparatus with an extendible command queue length from which the contents of the command queue are sequentially read out by control of read address signals sent from a read controller. The read controller also sends out a control signal for controlling latches which in turn recover the high byte data and the low byte data sent from the line buffer into data with 38-bit pattern.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
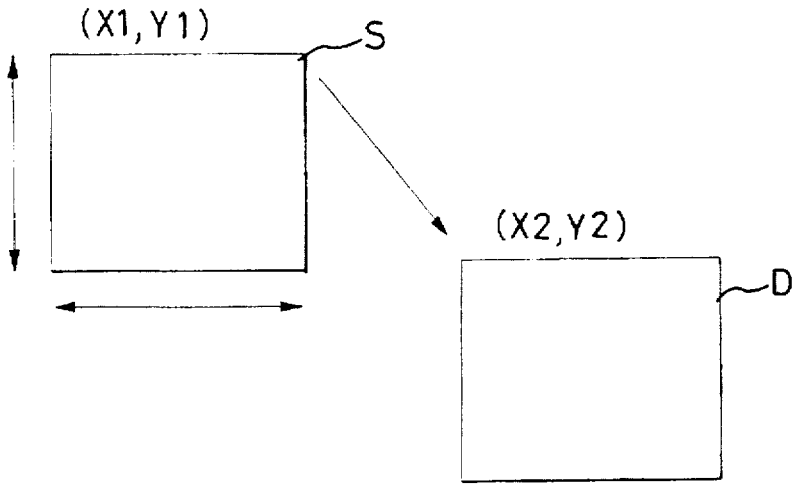
FIG. 1 is a schematic view showing a block is moved from a first position to a second position.
Figure 2:
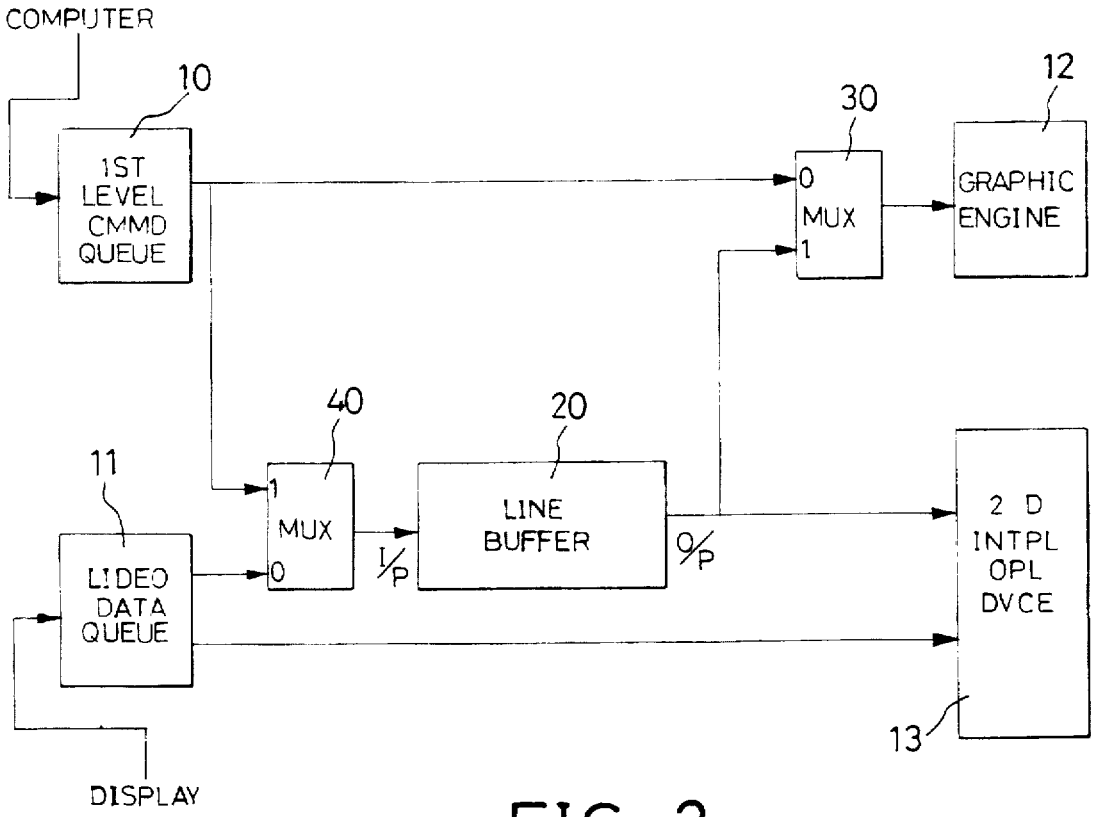
FIG. 2 is a block diagram of the present invention.

Referring to the drawings and initially to FIG. 2, a line buffer apparatus with an extendible command queue length comprises a first level command queue 10 for receiving commands from a computer; a line buffer 20 for temporarily receiving video data or command data, the line buffer 20 including a data input port I/P and a data output port O/P; an video data queue 11 for temporarily storing video data coming from a display memory; a first multiplexer 40 and a second multiplexer 30 respectively connected to the data input port I/P and the data output port O/P of the line buffer 20 for operatively enabling the line buffer 20 to receive command data coming from the first level command queue 10 or video data coming from the video data queue 11, and to output data into a graphic engine 12 or a two dimensional biline interpolation operational device 13.

When executing video enlargement, the video data is transferred to the video data queue 11 and the line buffer 20 so that the two dimensional biline interpolation operational device 13 can execute operation without being interrupted for waiting data transfer. The line buffer 20 is suspended when the video enlargement procedure is not executed. The present invention fully utilizes the line buffer 20 when the line buffer 20 does not execute video enlargement. When no video enlargement is executed, the multiplexers 30 and 40 are controlled by a control loop so that the "1" input terminals thereof are respectively connected to corresponding output terminals so that the first level command queue 10 is connected to the line buffer 20 via the first multiplexer 40 and the line buffer 20 is connected to the graphic engine 12 via the second multiplexer 30. In this situation, the command data from the computer are fetched to the first level command queue 10 and the line buffer 20 before being processed by the graphic engine 12. Therefore, the line buffer 20 is used as a second level command queue to share the task of the first level command queue 10, and the length of the overall command queue is extendible. Actually, the first level command queue 10 merely has 8 layers while the line buffer 20 has 176 layers when it is used as a second level command queue. Therefore, the line buffer 20 can considerably increase the efficiency of the window accelerator (used as a second level command queue) and release the burden of the CPU of the computer (used as the line buffer for temporarily storing video data).

The specification of the line buffer 20 should be preadjusted so as to meet the requirement of a command queue. The line buffer 20 is structured as 16 bits multiplied by 352 layers according to SIF standard and each layer is used for storing YUV data. However, the first level command queue 10 of the graphic window accelerator is structured as 38 bits multiplied by 8 layers, where 32 bits are used for data and 6 bits are used for address (since bit 1 and bit 0 are both "0" and omitted, only 6 bits are sufficient to represent the address). Since the first level command queue 10 is limited to the 38-bit pattern, the inventor the present invention has extended the structure of the line buffer 20 from 16 bits multiplied by 352 layers into 19 bits multiplied by 352 layers, where each layer is extended from 16 bits into 19 bits, and every two layers (together 38 bits) stands for one layer of the command queue. Therefore, the read/write control of the line buffer 20 requires section-by-section write in and a recovery step of high byte and low byte combination.

Figure 3:
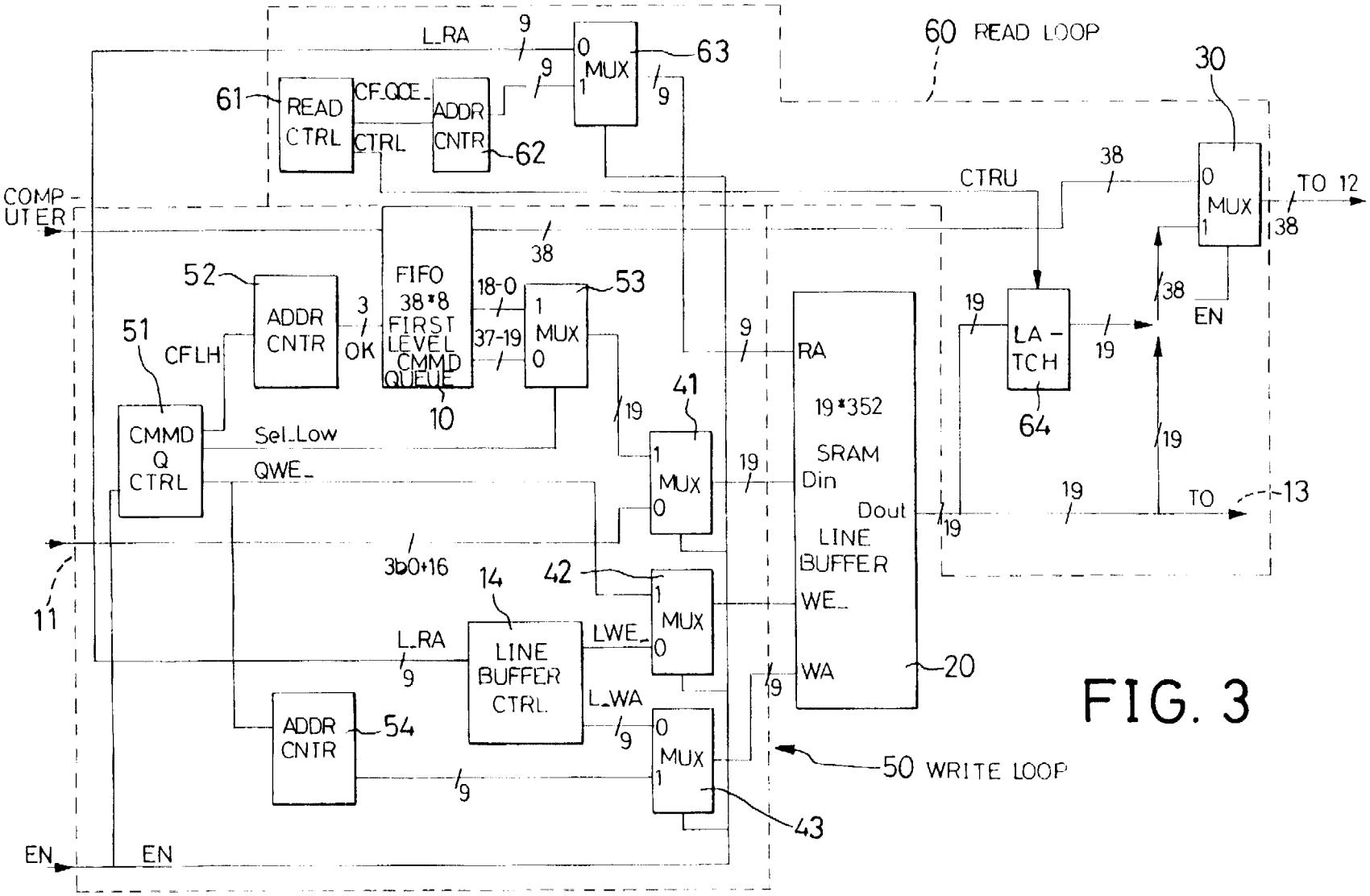
FIG. 3 is a schematic view of an internal structure of the present invention.

Hereinunder is an embodiment of the present invention. Referring to FIG. 3, a line buffer apparatus with an extendible command queue length comprises a line buffer 20 which is a SRAM with capacity of 19 bits multiplied by 352 layers, a write loop 50, and a read loop 60. The write loop 50 comprises a first level command queue 10, a command queue controller 51, a line buffer controller 14, two address counters 52 and 54, and a plurality of multiplexers 41, 42, 43, and 53. The read loop 60 comprises a read controller 61, an address counter 62, two multiplexers 63 and 30, and a latch 64.

Normally, the command queue is not extended and the line buffer 20 is used as a conventional buffer for temporarily storing video data. During this normal period, a switching selection signal EN at a logical low level is respectively sent to a control terminal of each of the multiplexers 41, 42, 43, 63, and 30 and the second multiplexer 30, thus causing the "0" terminal of each of the multiplexers 41, 42, 43, 63, and 30 to electrically connect to the corresponding output terminal thereof, and allowing the video data to be sent from the video data queue 11 via one of the first multiplexers 40 to a data input terminal Din of the line buffer 20. A write enable signal WE_ and a write address signal WA of the line buffer 20 are provided by the line buffer controller 14 for proceeding storage of video data. For reading the data stored in the line buffer 20, a read address signal L-RA is sent from the line buffer controller 14 via the multiplexer 63 to a read address input terminal RA of the line buffer 20 thus triggering the line buffer 20 to sequentially send out data from a data output terminal Dout thereof to the two dimensional biline interpolation operational device 13. The command data are sent from the CPU via the first level command queue 10 and the multiplexer 30 to the graphic engine 12.

When the accelerator does not execute video enlargement, the switching selection signal EN is changed from logical low level to logical high level, thus the output terminal of each of the multiplexers 41, 42, 43, 63, and 30 is electrically connected to their corresponding input terminal "1". In the mean time, the command queue controller 51 sends out two triggering signals CF and QWE_, which are respectively transferred to the address counters 52 and 54. The address counter 52 generates an address signal for the first level command queue 10. The address counter 54 generates a signal as the write address signal WE of the line buffer 20. The triggering signal QWE_ also functions as the write enable signal WE_ of the line buffer 20. The command queue controller 51 generates a high/low byte selection signal SEL-LOW for controlling the multiplexer 53 which has a "0" input port connected to the low byte portion (bit 1 to bit 19) of the output data of the first level command queue 10 and a "1" input port connected to the high byte portion (bit 20 to bit 38) of the output data of the first level command queue 10. The high/low byte selection signal alternately change between a logical high status and a logical low status. The multiplexer 53 is controlled by the high/low byte selection signal SEL-LOW so as to alternately transfers the high byte portion and the low byte portion of the output data of the first level command queue 10 into the liner buffer 20.

When reading data from the line buffer 20, the read controller 61 of the read loop 60 sequentially sends out read address signals RA, through the address counter 62 and the multiplexer 63, to the line buffer 20, thus the line buffer 20 send out high byte data and low byte data alternately. When the line buffer 20 sends out high byte data, a locking signal output from the read controller 61 controls the latch 64 to temporarily store the high byte data. The latch 64 releases the high byte data upon the corresponding low byte data being output from the line buffer, and the high byte data and the low byte data are combined to the 38-bit data. The combined 38-bit data are sent to the graphic engine 12 via the multiplexer 30.

It is appreciated that the command queue controller 51 and the read controller 61 can cooperate the multiplexers and the latch 64 to fully utilize the line buffer 20 as a second level command queue when video enlargement operation is not executed thus increasing the efficiency of the line buffer.

I claim:

1. A line buffer apparatus with an extendible command queue length, comprising:

a first level command queue for receiving commands from a computer;

a line buffer for temporarily receiving video data or a command queue, the line buffer including a data input port and a data output port;

a first multiplexer and a second multiplexer respectively connected to the data input port and the data output port of the line buffer for operatively enabling the line buffer to receive command data coming from a first level command queue or video data coming from a memory, and to output data into a graphic engine or a two dimensional operating device;

a controller for controlling the two multiplexers to selectively connect the line buffer between the first level command queue and the graphic engine so as to treat the line buffer as a second level command queue, when the line buffer does not temporarily store video, thereby flexibly extending the command queue length of an video window accelerator.

2. A line buffer apparatus as claimed in claim 1, wherein the first multiplexer includes two input terminals adapted to respectively receive the command data coming from the first level command queue and the video data coming from the memory and an output terminal connected to the data input port of the line buffer, and wherein the second multiplexer includes two input terminals adapted to respectively receive the output signal coming from the first level command queue and the data output signal coming from the line buffer and an output terminal connected to the graphic engine.

3. A line buffer apparatus as claimed in claim 1, wherein the controller comprises a write loop and a read loop respectively allowing a writing operation and a reading operation of the command queue of the line buffer.

4. A line buffer apparatus as claimed in claim 3, wherein the read loop comprises a read controller, an address counter, a multiplexer, and a data latch, wherein the read controller enables the address counter to supply the line buffer with required read address signal thereby fetching contents stored in the line buffer.

5. A line buffer apparatus as claimed in claim 4, wherein the data latch is connected to the data output terminal of the line buffer and is controlled by a locking signal coming from the read controller for temporarily storing the high byte portion of the command data byte and incorporates the high byte portion with a low byte portion into one byte of command data upon receiving the low byte portion from the line buffer.

6. A line buffer apparatus as claimed in claim 1, wherein a write loop comprises a command queue controller, an address counter, a line buffer controller, and a plurality of multiplexers; the command queue controller outputting a plurality of triggering signals which are respectively sent to an address input terminal of the first level command queue and a write address input terminal of the line buffer via an address counter, the multiplexers being connected to a data input terminal, a write enable input terminal, and a write address input terminal of the line buffer and respectively switching the data input terminal, the write enable input terminal, and the write address input terminal of the line buffer to selectively receive one of the video signal and the output signal of the first level command queue under control of a switching selection signal.

7. A line buffer apparatus as claimed in claim 6, wherein the command queue controller generates a selection signal for enabling the first level command queue to send alternately a high byte portion and a low byte portion of the command data to the line buffer.

8. A line buffer apparatus as claimed in claim 7, wherein the command output signal outputted from the first level queue are separated into a high byte portion signal and a low byte portion signal and the multiplexer includes a selection terminal adapted to receive the selection signal outputted from the command queue controller.

9. A line buffer apparatus as claimed in claim 7, wherein the line buffer uses two bytes of data to represent one byte of command data, wherein the bit number of each byte of data in the line buffer is half of the bit number of each byte of command data.

10. A line buffer apparatus with an extendible command queue length, comprising:

a first level command queue for receiving commands from a computer;

a line buffer for temporarily receiving video data or a command queue, the line buffer including a data input port and a data output port;

a controller including a write loop and a read loop for controlling read/write of the line buffer, the read loop and the write loop each comprising a plurality of multiplexers for interconnecting the line buffer between a first level queue and a graphic engine thus enabling the line buffer to function as a second level command queue when the line buffer is not storing videos, thereby flexibly extending the command queue length of an video window accelerator.

11. A line buffer apparatus as claimed in claim 10, wherein the write loop comprises a command queue controller, an address counter, a line buffer controller, and a plurality of multiplexers; the command queue controller outputting a plurality of triggering signals which are respectively sent to an address input terminal of the first level command queue and a write address input terminal of the line buffer via an address counter, the multiplexers being connected to a data input terminal, a write enable input terminal, and a write address input terminal of the line buffer and respectively switching the data input terminal, the write enable input terminal, and the write address input terminal of the line buffer to selectively receive one of the video signal and the output signal of the first level command queue under control of a switching selection signal.

12. A line buffer apparatus as claimed in claim 11, wherein the command queue controller generates a selection signal for enabling the first level command queue to send alternately a high byte portion and a low byte portion of the command data to the line buffer.

13. A line buffer apparatus as claimed in claim 12, wherein the command output signal outputted from the first level queue are separated into a high byte portion signal and a low byte portion signal and the multiplexer includes a selection terminal adapted to receive the selection signal outputted from the command queue controller.

14. A line buffer apparatus as claimed in claim 10, wherein the line buffer uses two bytes of data to represent one byte of command data, wherein bit number of each byte of data in the line buffer is half of bit number of each byte of command data.

15. A line buffer apparatus as claimed in claim 10, wherein the read loop comprises a read controller, an address counter, a multiplexer, and a data latch, wherein the read controller enables the address counter to supply the line buffer with required read address signal thereby fetching contents stored in the line buffer.

16. A line buffer apparatus as claimed in claim 15, wherein the data latch is connected to the data output terminal of the line buffer and is controlled by a locking signal coming from the read controller for temporarily storing the high byte portion of the command data byte and incorporates the high byte portion with a low byte portion into one byte of command data upon receiving the low byte portion from the line buffer.

* * * * *